US010819057B1

(12) United States Patent
Farole et al.

(10) Patent No.: US 10,819,057 B1
(45) Date of Patent: Oct. 27, 2020

(54) ELECTRICAL TERMINAL WITH RESILIENT CONTACT ARM WITH LOW INSERTION FORCE AND HIGH NORMAL FORCE

(71) Applicant: TE CONNECTIVITY CORPORATION, Berwyn, PA (US)

(72) Inventors: Dominic Anthony Farole, Hummelstown, PA (US); Richard Benjamin Emenheiser, Mount Joy, PA (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 16/382,395

(22) Filed: Apr. 12, 2019

(51) Int. Cl.
*H01R 13/187* (2006.01)
*H01R 4/20* (2006.01)
*H01R 4/18* (2006.01)

(52) U.S. Cl.
CPC ..... *H01R 13/187* (2013.01); *H01R 4/184* (2013.01); *H01R 4/20* (2013.01)

(58) Field of Classification Search
CPC ..... H01R 13/187; H01R 4/20; H01R 4/184
USPC ..... 439/843, 845, 847, 851
See application file for complete search history.

(56) References Cited

U.S. PATENT DOCUMENTS 5,607,328 A * 3/1997 Joly ..... H01R 13/11 439/851
8,911,253 B2 12/2014 Myer et al.
9,099,796 B2 8/2015 Myer et al.
2009/0017699 A1* 1/2009 Breen, IV ..... H01R 4/22 439/723
2015/0099408 A1* 4/2015 Myer ..... H01R 13/187 439/884

* cited by examiner

*Primary Examiner* — Abdullah A Riyami
*Assistant Examiner* — Nelson R. Burgos-Guntin

(57) ABSTRACT

An electrical terminal with a contact portion and a spring arm and a method of insertion. The contact portion has a mating terminal receiving cavity. The spring arm extends from a bottom wall into the mating terminal receiving cavity. The spring arm has a fixed end, a free end and a transition section extending between the fixed end and the free end. The bottom wall has an opening with a front wall and a rear wall. The spring arm extends from the front wall toward the rear wall. A coined area is provided proximate the rear wall of the opening on the bottom wall. The spring arm acts initially as a single supported cantilever beam and then, upon deflection, acts as a double supported beam.

20 Claims, 4 Drawing Sheets

ELECTRICAL TERMINAL WITH RESILIENT CONTACT ARM WITH LOW INSERTION FORCE AND HIGH NORMAL FORCE

FIELD OF THE INVENTION

The present invention is directed to an electrical terminal with a resilient contact arm with a low insertion force and a high normal force and a method of deforming a spring arm of an electrical terminal to provide low insertion force and high normal force. In particular, the invention is directed to a receptacle terminal which provides sufficient normal force to provide a stable interconnection with a mating terminal to provide a stable electrical resistance regardless of the environmental conditions.

BACKGROUND OF THE INVENTION

Socket terminals, such as tab receptacle terminals, which are adapted for quick make and break connections with a mating terminal or mating tab, are known. Terminals of this kind are used to make an electrical connection to a male or tab terminal which is inserted and frictionally held in the socket terminal.

It is often necessary to disconnect and reconnect such terminals a number of times, for example, for testing purposes prior to final inspection and shipment of the product on which such terminals are used. It is also required that the connection made with such terminals be maintained under conditions of vibration and possible strain in subsequent service. However, due to the configuration of the tab receptacle terminal, such tab receptacle terminals often have undesirable high insertion forces or undesirably low normal forces, resulting in a large variation of the electrical resistance of the mated terminals when exposed to different environment conditions. In addition, the spring members of the tab receptacle terminals may yield when mating occurs, causing the mechanical and electrical connection to fail.

These problems are particularly present in smaller connectors which require that the spring members have tighter pitches. Providing adequate normal force on the contact interfaces for smaller connectors is more difficult. For power applications, this problem becomes more severe as normal force is inversely proportionate to interface resistance. Known designs do not provide adequate normal force and therefore presents relatively high changes in resistance after environmental/mechanical conditioning.

It would, therefore, be beneficial to provide an electrical terminal with a contact arm with a low insertion force and a high normal force. It would also be beneficial to provide a receptacle which provides sufficient normal force to provide a stable interconnection with a mating contact to provide for stable electrical resistance regardless of the environmental conditions.

SUMMARY OF THE INVENTION

An embodiment is directed to a an electrical terminal with a contact portion and a spring arm. The contact portion has a bottom wall, side walls and top walls, the top walls being spaced from the bottom wall and extending in a plane which is essentially parallel to the plane of the bottom wall. The bottom wall, side walls and top walls form a mating terminal receiving cavity. The spring arm extends from the bottom wall into the mating terminal receiving cavity. The spring arm has a fixed end, a free end and a transition section extending between the fixed end and the free end. The bottom wall has an opening with a front wall and a rear wall. The spring arm extends from the front wall toward the rear wall. A coined area is provided proximate the rear wall of the opening on the bottom wall. The coined area is provided at the rear wall of the opening and extends into the opening. The length of the opening as measured from the front wall of the opening to a wall of the coined area is less than the length of the spring arm as measured from the fixed end to the free end. The spring arm acts initially as a single supported cantilever beam and then, upon deflection and engagement with the coined areas, acts as a double supported beam.

An embodiment is directed to a method of deforming a spring arm of an electrical terminal to provide low insertion force and high normal force. The method includes: inserting a mating terminal into a mating terminal receiving cavity of the terminal, causing the spring arm to deform as a single supported cantilever beam, supported only at a fixed end, providing the low insertion force for the mating terminal; and further deforming the spring arm causing a free end of the spring arm to engage a coined area of a bottom wall of the terminal, causing the spring arm to deform a double supported beam, supported at both a fixed end of the spring beam and the free end, providing the high normal force between the terminal and the mating terminal.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
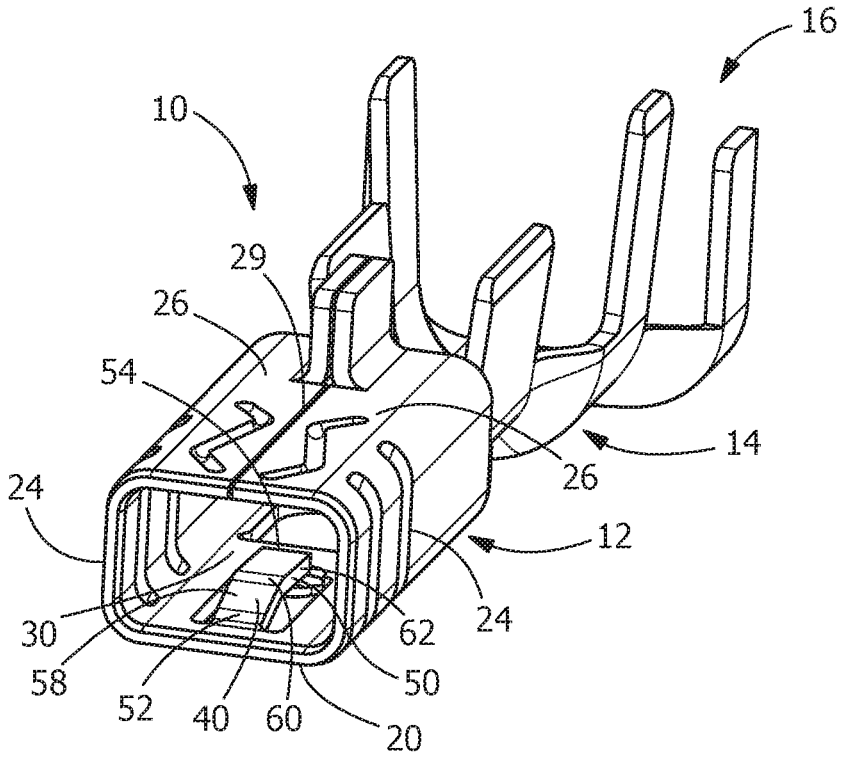
FIG. 1 is a perspective view of an illustrative embodiment of the terminal of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As best shown in FIG. 1, a receptacle, socket or female electrical terminal 10 includes a contact portion 12, a wire barrel 14 behind the contact portion 12 and an insulation barrel 16 behind the wire barrel 14. The wire barrel 14 is configured for crimped connection with an end of a conductive core of an insulated wire. The insulation barrel 16 is configured for crimped connection with an end of the insulation coating or jacket of the wire. Although a wire barrel 14 and an insulation barrel 16 are shown, the contact portion 12 can be used with other types of termination members without departing from the scope of the invention. In the illustrative embodiment shown, the terminal 10 is stamped and formed from a metal plate having a good electrical conductivity.

Figure 2:
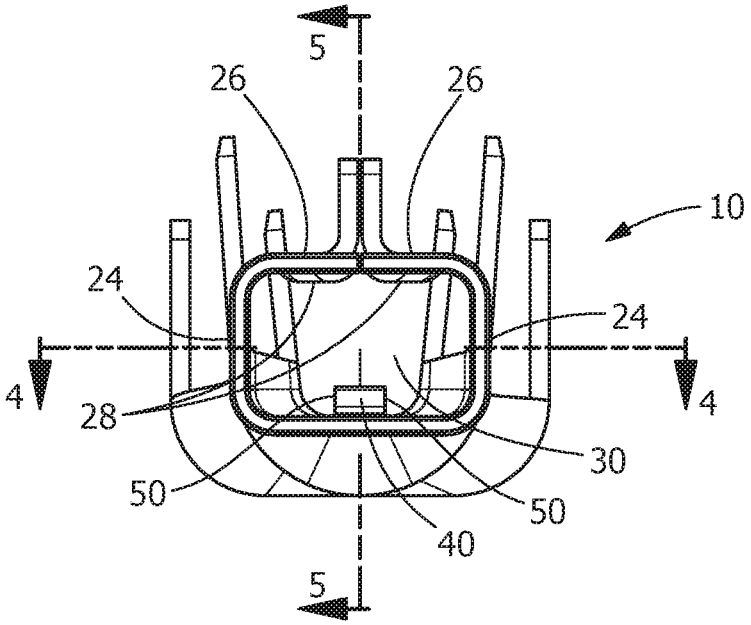
FIG. 2 is a front view of the terminal of FIG. 1.

Referring to FIGS. 1 and 2, the contact portion 12 includes a bottom wall 20, side walls 24 and top walls 26. In the illustrative embodiment shown, the top walls 26 are spaced apart by a seam 29. The top walls 26 are spaced from the bottom wall 20 and extend in a plane which is essentially parallel to the plane of the bottom wall 20. The side walls 24 extend in a plane which is essentially perpendicular to the plane of the bottom wall and the plane of the top walls 26. Mating terminal engaging sections 28 extend from the top walls 26 in a direction toward the bottom wall 20. The bottom wall 20, side walls 24 and top walls 26 form a mating terminal receiving cavity 30. However, other configurations of the contact portion 12 can be used without departing from the scope of the invention. Different configurations of the contact portion 12 allows the stiffness and spring rate of the contact portion 12 to be controlled.

Figure 3:
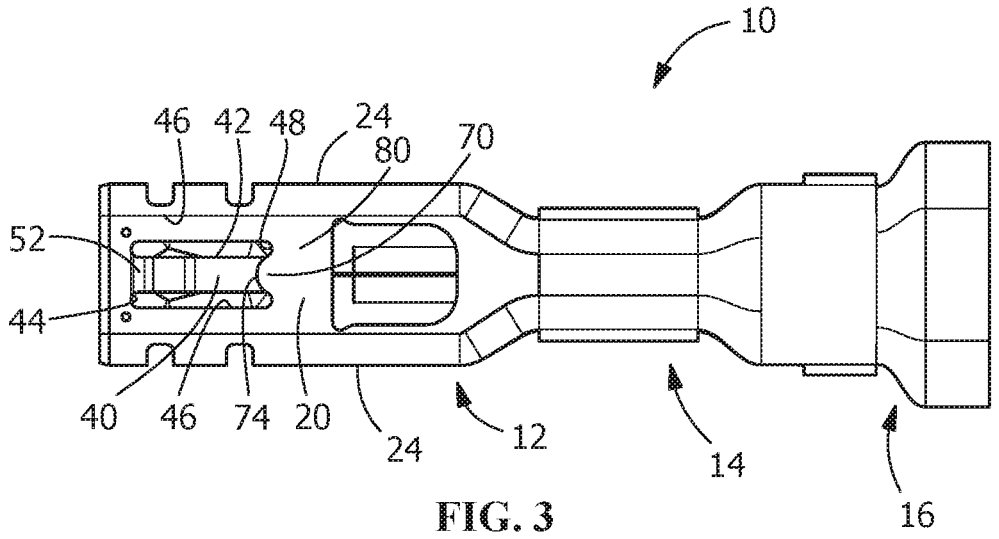
FIG. 3 is a bottom view of the terminal of FIG. 1.
Figure 4:
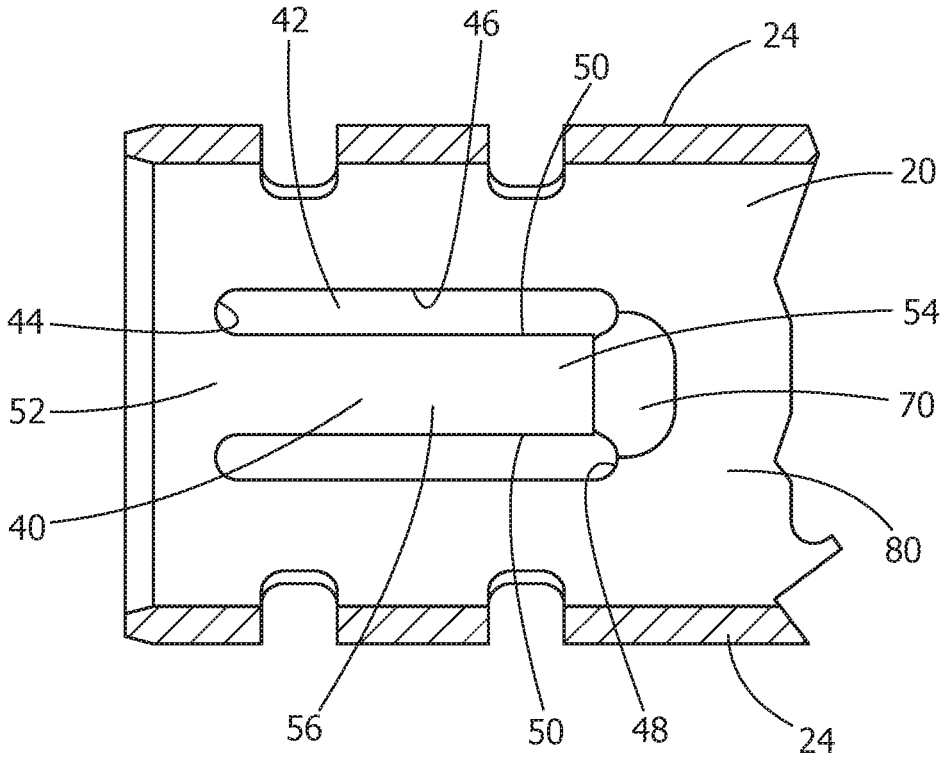
FIG. 4 is a cross-section view of a contact portion of the terminal taken along line 4-4 of FIG. 1.

As best shown in FIGS. 3 through 7, the bottom wall 20 has a spring finger or spring arm 40 provided thereon. The spring arm 40 is stamped and formed from the bottom wall 20. As best shown in FIG. 3, material is stamped from the bottom wall 20 to form an opening 42 which has a front wall 44, side walls 46 and a rear wall 48. A portion of the stamped material is removed to form the spring arm 40. By removing a portion of the material, the spring arm 40 is not as wide as the opening 42. In other words, the width of the spring arm 40 as measured between side surface 50 of the spring arm 40 is less than the width of the opening 42 as measured between the side walls 46 of the opening.

The spring arm 40 extends from the front wall 44 of the opening 42 on the bottom wall 20 to create a raised portion or arm which extends from the the bottom wall 20 into the mating terminal receiving cavity 30 toward the top walls 26.

The spring arm 40 has a fixed end 52, a free end 54 and a transition section 56 which extends between the fixed end 52 and the free end 54. The spring arm 40 is formed to allow the free end 54 to move or be resiliently deformed relative to the bottom wall 20, allowing the spring arm 40 to move in the mating terminal receiving cavity 30 in a direction toward and away from the top walls 26.

The transition section 56 of the spring arm 40 includes a mating terminal camming portion 58, a mating terminal engagement section 60 and a bottom wall engagement section 62. The mating terminal camming portion 58 extends from the fixed end 52 in a direction toward the free end 54. The bottom wall engagement section 62 extends from the free end 54 in a direction toward the fixed end 52. The mating terminal engagement section 60 is positioned between the mating terminal camming portion 58 and the bottom wall engagement section 62.

The mating terminal camming portion 58 extends from the fixed end 52 at an inclined angle to allow the mating terminal camming portion 58 to engage the mating terminal 90 (FIG. 6) as the mating terminal 90 is inserted into the mating terminal receiving cavity 30. The mating terminal engagement section 60 has a curved or arcuate configuration. The bottom wall engagement section 62 extends from mating terminal engagement section 60 at a declined angle to allow the bottom wall engagement section 62 to engage a portion of the bottom wall 20 (FIG. 7) as the mating terminal 90 nears the fully inserted position or is fully inserted into the mating terminal receiving cavity 30.

Figure 7:
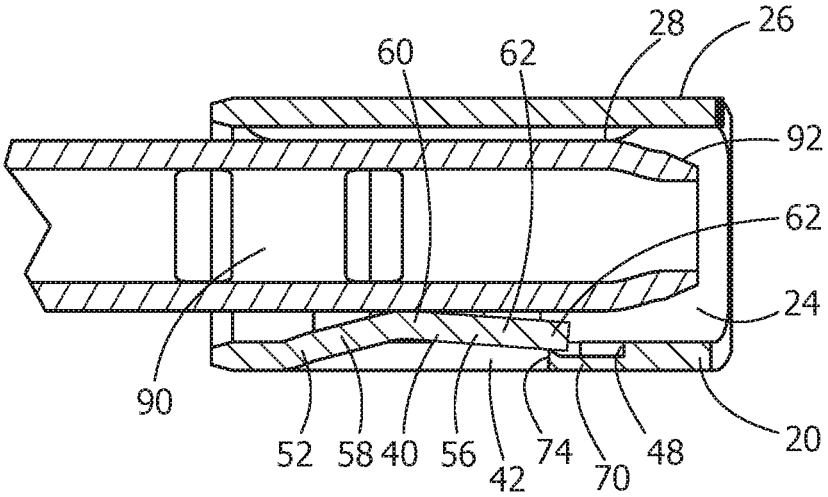
FIG. 7 is a cross-section view similar to FIG. 6, showing the mating terminal fully inserted into the of the contact portion of the terminal.

A recessed or coined area 70 is provided on the bottom wall 20. The coined area 70 is provided at the rear wall 48 of the opening 42. The coined area 70 is formed by coining or compressing an area of material of the bottom wall 20 causing the material to flow into the opening 42. The flow of material into the opening 42 causes the length of the opening 42 as measured from the front wall 44 to a wall 74 of the coined area 70 to be less than the length of the spring arm 40 as measured from the fixed end 52 to the free end 54 (as best shown in FIG. 7). In the embodiment shown, the wall 74 of the coined area has a curved or arcuate configuration.

The coined area 70 extends from a portion 80 of the bottom wall 20. The portion 80 is configured to allow the portion 80 to have controlled flexibility or resiliency relative to the side walls 24 of the contact portion 12.

In alternate illustrative embodiments, the coined area may be provided on the free end 54 of the spring arm 40. The coined area is formed by coining or compressing an area of material of the free end of the spring arm causing the material to grow or flow and elongate the length of the spring arm 40. The flow of material causes the length of the opening 42 as measured from the front wall 44 to the rear wall 48 to be less than the length of the spring arm 40 as measured from the fixed end 52 to the free end 54. Consequently, the coined area 70 is positioned in the opening 42 under the free end 54 of the spring arm 40.

Figure 5:
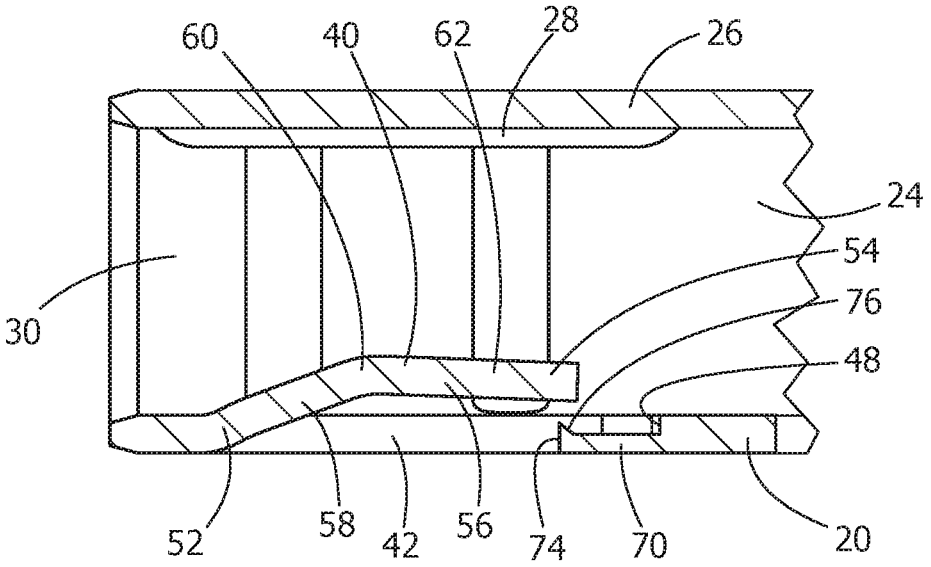
FIG. 5 is a cross-section view of contact portion of the terminal taken along line 5-5 of FIG. 1.
Figure 6:
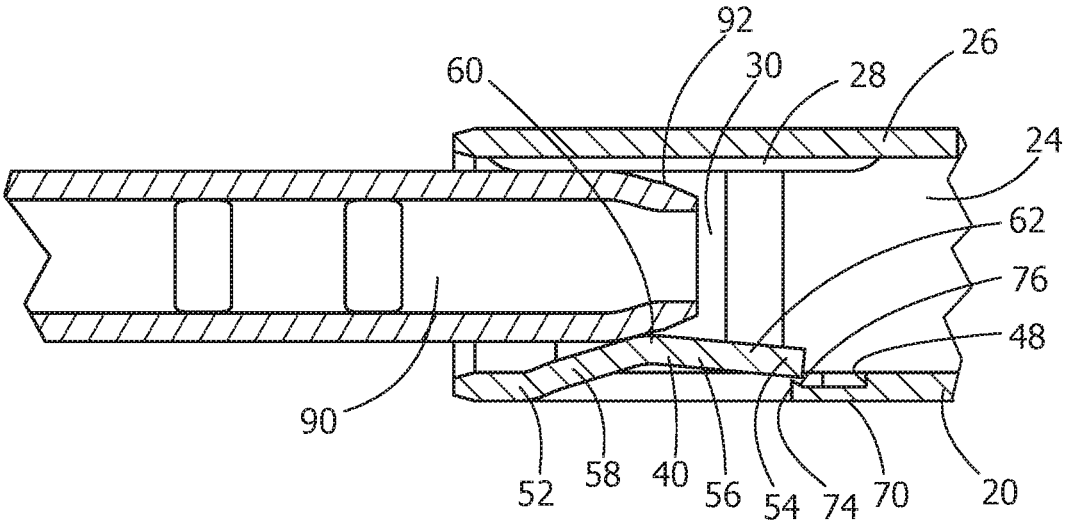
FIG. 6 is a cross-section view similar to FIG. 5, showing a mating terminal partially inserted into the of the contact portion of the terminal.

A raised geometric projection 76, as best shown in FIGS. 5 through 7 may be formed proximate the wall 74 of the material of the coined area 70. In the illustrative embodiment shown, the raised projection 76 has a triangular shape, as viewed in FIG. 5. As the raised projection 76 is formed from proximate the wall 74, the raised projection 76 when viewed from the top walls 26, in the embodiment shown, also has a curved or arcuate configuration which conforms to the shape of the wall 74. However other shapes of raised projection 76 may be used. In order to provide the raised projection 76, the tool (not shown) used to compress or coin the coined area 70 does not engage and does not compress the raised projection 76.

In the initial, unstressed position, prior to the insertion of the mating terminal 90, as shown in FIG. 5, the spring arm 40 extends into the mating terminal receiving cavity 30 and is in an unstressed position.

As the mating terminal 90 is inserted into the mating terminal receiving cavity 30 of the terminal 10, a front end 92 of the terminal 90 engages the mating terminal camming portion 58, moving the spring arm 40 to a stressed position. During the initial movement of the spring arm 40, the spring arm 40 is a single supported cantilever beam, supported only at the fixed end 52. In order to provide a low insertion force for the mating terminal, the mating terminal camming portion 58 of the spring arm 40 has a modest and gradual angle of inclination.

As insertion continues, the mating terminal 90 engages the mating terminal engaging sections 28 of the top walls 26, thereby preventing the further movement of the mating terminal 90 toward the top walls 26.

The continued insertion of the mating terminal 90 causes the front end 92 of the mating terminal 90 to engage the mating terminal engagement section 60, causing the spring arm 40 to be further stressed position. Consequently, the continued insertion of the mating terminal 90 causes the mating terminal 90 to exert force on the mating terminal engagement section 60, which in turn causes the mating terminal engagement section 60 and the bottom wall engagement section 62 of the spring arm 40 to deflect downward.

The downward movement of the mating terminal engagement section 60 and the bottom wall engagement section 62 of the spring arm 40 continues until the free end 54 engages the raised projection 76 of the coined area 70 of the bottom wall 20. The raised projection 76 provides a high pressure point contact. Once the free end 54 engages the raised projection 76, the spring arm 40 acts as a double supported beam, supported at both the fixed end 42 and the free end 52.

With the free end 54 of the bottom wall engagement section 62 of the spring arm 40 in engagement with the raised projection 76 of the coined area 70 of the bottom wall 20, the continued deflection or downward movement of the free end 54 of the bottom wall engagement section 62 of the spring arm 40 is reduced or prevented. As this occurs, the fixed end 52 and the free end 54 are inhibited or prevented from moving downward, in a direction which is transverse to a longitudinal axis of the terminal 10 or the mating terminal 90.

With the fixed end 52 and the free end 54 inhibited or prevented from moving downward, in a direction which is transverse to a longitudinal axis of the terminal 10 or the mating terminal 90, continued insertion of the mating terminal 90 causes the continued movement of the mating terminal engagement section 60.

As the portion 80 has controlled flexibility or resiliency relative to the side walls 24 of the contact portion 12, the portions provides additional deflection when a large force is applied to the spring arm 40, thereby helping to prevent the spring arm 40 from taking a permanent set.

In the fully inserted position, as shown in FIG. 7, the free end 54 of the bottom wall engagement section 62 is engaged with the raised projection 76 and the mating terminal engagement section 60 is in contact with the mating terminal 90. As the fixed end 52 and the free end 54 prevented from moving downward, in a direction which is transverse to a longitudinal axis of the terminal 10 or the mating terminal 90, the force exerted by the mating terminal engagement section 60 on the mating terminal 90 is increased to provide a sufficient force to maintain the mechanical and electrical contact between the mating terminal engagement section 60 on the mating terminal 90.

As the free end 54 of the spring arm 40 is allowed to move as the mating terminal 90 in initially inserted into the mating terminal receiving cavity 30, the spring arm 40 has a relatively low spring rate to allow for ease of insertion. However, when the free end 54 engages the raised projection 74 of the coined area 70 and is prevented from moving downward, in a direction which is transverse to a longitudinal axis of the terminal 10 or the mating terminal 90, the spring rate of the mating terminal engagement section 60 on the mating terminal 90 is increased to provide a sufficient force to maintain the mechanical and electrical contact between the mating terminal engagement section 60 on the mating terminal 90.

The method of deforming a spring arm of an electrical terminal 10 to provide low insertion force and high normal force, includes: inserting a mating terminal 90 into a mating terminal receiving cavity 30 of the terminal 10, causing the spring arm 40 to deform as a single supported cantilever beam, supported only at a fixed end 52, providing the low insertion force for the mating terminal; and further deforming the spring arm 40 causing a free end 54 of the spring arm 40 to engage a coined area 70 of a bottom wall 20 of the terminal 10, causing the spring arm 40 to deform a double supported beam, supported at both a fixed end 42 of the spring beam 40 and the free end 52, providing the high normal force between the terminal 10 and the mating terminal 90.

The method may also include deflecting a portion 80 of the bottom wall 20 of the terminal 10 to which the coined area is attached to prevent the spring arm 40 from taking a permanent set.

By providing a spring arm which starts out initially as a single supported cantilever beam and then, upon deflection, goes into a double supported beam, the spring rate of the spring arm 40 can be controlled. The normal forces and insertion forces associated with the contact portion 12 of the terminal 10 can be also be controlled, while allowing for a proper electrical connection between the terminal 10 and the mating terminal 90. For example, the insertion force of a terminal made according to the present invention may be reduced in comparison to other terminals, while the mating or normal force when fully inserted may be greater in comparison to other terminals. This allows the mating terminal and terminal 10 to be more durable over numerous cycles and allows the terminal to be used for high current applications.

In the illustrative embodiment, the insertion force may be 6 Newtons or lower and the normal force may be 13 Newtons or higher, illustrating that insertion force is low for the resultant high normal force and the ability for the contact system to carry a large current. However, values for the insertion force and normal force may be used without departing from the scope of the invention.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical terminal comprising:

a contact portion having a bottom wall, side walls and top walls, the top walls being spaced from the bottom wall and extending in a plane which is essentially parallel to the plane of the bottom wall, the bottom wall, side walls and top walls forming a mating terminal receiving cavity;

a spring arm extending from the bottom wall into the mating terminal receiving cavity, the spring arm having a fixed end, a free end and a transition section extending between the fixed end and the free end; and the bottom wall having an opening with a front wall and a rear wall, the fixed end of the spring arm positioned adjacent the front wall, the transition section and the free end of the spring arm positioned between the front wall and the rear wall;

a coined area extending from the rear wall of the opening into the opening toward the front wall, the coined area having a projecting wall which is spaced from the rear wall of the opening, a distance as measured from the front wall of the opening to the projecting wall of the coined area being less than a length of the spring arm as measured from the fixed end to the free end;

wherein upon deflection, the spring arm acts initially as a single supported cantilever beam and then, upon the free end of the spring arm engaging the coined area, the spring arm acts as a double supported beam.

2. The electrical terminal as recited in claim 1, wherein a raised projection is formed proximate the projecting wall of the coined area.

3. The electrical terminal as recited in claim 2, wherein the raised projection has a triangular shape.

4. The electrical terminal as recited in claim 2, wherein the coined area extends from a portion of the bottom wall, the portion configured to allow the portion to have controlled flexibility relative to the side walls of the contact portion.

5. The electrical terminal as recited in claim 1, wherein the transition section of the spring arm includes a mating terminal camming portion, a mating terminal engagement section and a bottom wall engagement section, the mating terminal camming portion extends from the fixed end in a direction toward the free end, the bottom wall engagement section extends from the free end in a direction toward the fixed end, the mating terminal engagement section is positioned between the mating terminal camming portion and the bottom wall engagement section.

6. The electrical terminal as recited in claim 5, wherein the mating terminal camming portion extends from the fixed end at an inclined angle to allow the mating terminal camming portion to engage a mating terminal as the mating terminal is inserted into the mating terminal receiving cavity.

7. The electrical terminal as recited in claim 5, wherein the mating terminal engagement section has a curved or arcuate configuration.

8. The electrical terminal as recited in claim 5, wherein the bottom wall engagement section extends from mating terminal engagement section at a declined angle to allow the bottom wall engagement section to engage a portion of the bottom wall as the mating terminal is fully inserted into the mating terminal receiving cavity.

9. The electrical terminal as recited in claim 1, wherein a width of the spring arm as measured between side surfaces of the spring arm is less than a width of the opening as measured between side walls of the opening.

10. The electrical terminal as recited in claim 1, wherein mating terminal engaging sections extend from the top walls in a direction toward the bottom wall.

11. A method of deforming a spring arm of an electrical terminal to provide low insertion force and high normal force, the method comprising:

inserting a mating terminal into a mating terminal receiving cavity of the terminal, causing the spring arm to deform as a single supported cantilever beam, supported only at a fixed end, providing the low insertion force for the mating terminal; and further deforming the spring arm causing a free end of the spring arm to engage a coined area of a bottom wall of the terminal, causing the spring arm to deform as a double supported beam, supported at both a fixed end of the spring beam and the free end, providing the high normal force between the terminal and the mating terminal.

12. The method as recited in claim 11, further comprising:

deflecting a portion of the bottom wall of the terminal to which the coined area is attached to prevent the spring arm from taking a permanent set.

13. The method as recited in claim 11, wherein a raised projection is formed proximate a wall of the coined area.

14. The method as recited in claim 12, wherein the raised projection has a triangular shape.

15. The method as recited in claim 12, wherein the raised projection provides a high pressure point contact.

16. The method as recited in claim 11, wherein the spring arm extends from the bottom wall into the mating terminal receiving cavity, the spring arm having a transition section extending between the fixed end and the free end.

17. The method as recited in claim 16, wherein the transition section of the spring arm includes a mating terminal camming portion, a mating terminal engagement section and a bottom wall engagement section, the mating terminal camming portion extends from the fixed end in a direction toward the free end, the bottom wall engagement section extends from the free end in a direction toward the fixed end, the mating terminal engagement section is positioned between the mating terminal camming portion and the bottom wall engagement section.

18. The method as recited in claim 16, wherein the mating terminal camming portion extends from the fixed end at an inclined angle to allow the mating terminal camming portion to engage a mating terminal as the mating terminal is inserted into the mating terminal receiving cavity.

19. The method as recited in claim 16, wherein the mating terminal engagement section has a curved or arcuate configuration.

20. The method as recited in claim 16, wherein mating terminal engaging sections extend from the top walls is a direction toward the bottom wall.

* * * * *